US005307531A

United States Patent [19]

Kao

[11] Patent Number: 5,307,531

[45] Date of Patent: May 3, 1994

[54] ROCKING CRADLE AIDED BY MAGNETS

[76] Inventor: Yao-Tzung Kao, No. 7, Section 3, Pei An Road, Tainan, Taiwan

[21] Appl. No.: 948,575

[22] Filed: Sep. 23, 1992

[51] Int. Cl.[5] ..... A47D 9/02

[52] U.S. Cl. ..... 5/108; 5/101; 5/906; 248/140

[58] Field of Search ..... 248/139, 130, 140, 370; 5/101, 108, 109, 906, 102, 103, 104, 105, 106, 107

[56] References Cited

U.S. PATENT DOCUMENTS

| | | | |
|---|---|---|---|
| 3,849,812 | 11/1974 | Walsh | 5/108 |
| 4,996,732 | 3/1991 | Chang | 5/101 |
| 5,048,135 | 9/1991 | Chen | 5/109 |

FOREIGN PATENT DOCUMENTS

| | | | |
|---|---|---|---|
| 2646763 | 11/1990 | France | 5/109 |

*Primary Examiner*—Richard K. Seidel
*Assistant Examiner*—Clark F. Dexter
*Attorney, Agent, or Firm*—Morton J. Rosenberg; David I. Klein

[57] ABSTRACT

A rocking cradle is provided which allows for a hanging cradle contained within a supporting frame to be aided in its cyclical transverse displacement by magnetic attraction and repelling forces. Central magnets are mounted on the hanging cradle and are attracted and repelled by a pair of magnets mounted on the supporting frame with one of the magnets being fixed to the supporting frame and the other magnet being rotatively displaceable with respect to the first magnet. Transverse displacement of the hanging cradle causes pivoting of one of the magnets on the supporting frame which then allows a repelling force from the stationary magnet to act against the magnets mounted on the hanging cradle to displace the hanging cradle away from the magnets on the supporting frame.

1 Claim, 2 Drawing Sheets

ROCKING CRADLE AIDED BY MAGNETS

BACKGROUND OF THE INVENTION

There are numerous prior art types of cradles being used. Some of these prior art cradles have a rocking wooden horse with other types being manually displaceable with ropes. Still other types of cradles are mounted within fixed standing frames while others are electrically actuated for rocking displacement. Such conventional cradles include disadvantages including:

1. A cradle having a manually actuated rocking horse must be continuously displaced;
2. Cradles hung between fixed posts are generally inconvenient and restrictive due to the fact that such are not portable;
3. Cradles hung on standing frames must be continuously manually activated with frequent manual intervention;
4. Cradles which are displaced manually must be frequently pushed which is somewhat inconvenient; and,
5. Electrically actuated cradles remove manual operation, however, such include the complexities of electrically operating systems and are dependent on a source of electricity.

SUMMARY OF THE INVENTION

This invention provides a cradle which may be maintained in a rocking mode with a minimal amount of manual intervention once the rocking displacement is initiated manually. The cradle operates by magnets disposed in the cradle to attract and repel each other during different displacement locations of the cradle.

Improvements found by use of this invention are as follows:

1. The rocking force for the cradle is partially derived from attracting and repelling interaction between magnets provided in the cradle and magnets provided in a support frame without the use of a motor;
2. Provision of magnets in the system does not rely on electrical actuation and is substantially silent in operation thus not interrupting the sleep of a baby in the cradle;
3. Attracting and repelling interaction between the magnets maintains cradle displacement over an extended period of time once manually displaced; and,
4. The cradle decreases the amount of times that manual displacement must be used.

This invention comprises a hanging cradle, a support frame defining an open enclosure standing on the ground to support the cradle within the enclosure surrounded by the support frame which has an inverted V-shaped portion at both upper opposite sides and a bearing base fixed on the top of each inverted V-shaped portion. The bearing base is fixed with an inverted V-shaped rod having two lower ends connected fixedly with a horizontal rectangular upper frame of the cradle. The bearing base in combination with the inverted V-shaped rod allows the cradle to be rocked or pivotally displaced in a cyclical manner.

A pair of central magnets are provided at two longitudinally opposing ends of the upper frame of the cradle. Two pairs of two actuating magnets in a rocking device are fixed on the inverted V-shaped portions of the support frame so that the central magnets can initially be attracted and then repelled to allow the cradle to rock back and forth subsequent to the cradle being displaced manually. The attracting and repelling forces generated between the central magnets and the actuating magnets in the rocking device allows the hanging cradle to rock or be cyclically displaced in a continuous manner over an extended period of time without manual intervention.

DESCRIPTION OF THE PREFERRED EMBODIMENTS

Figure 1:
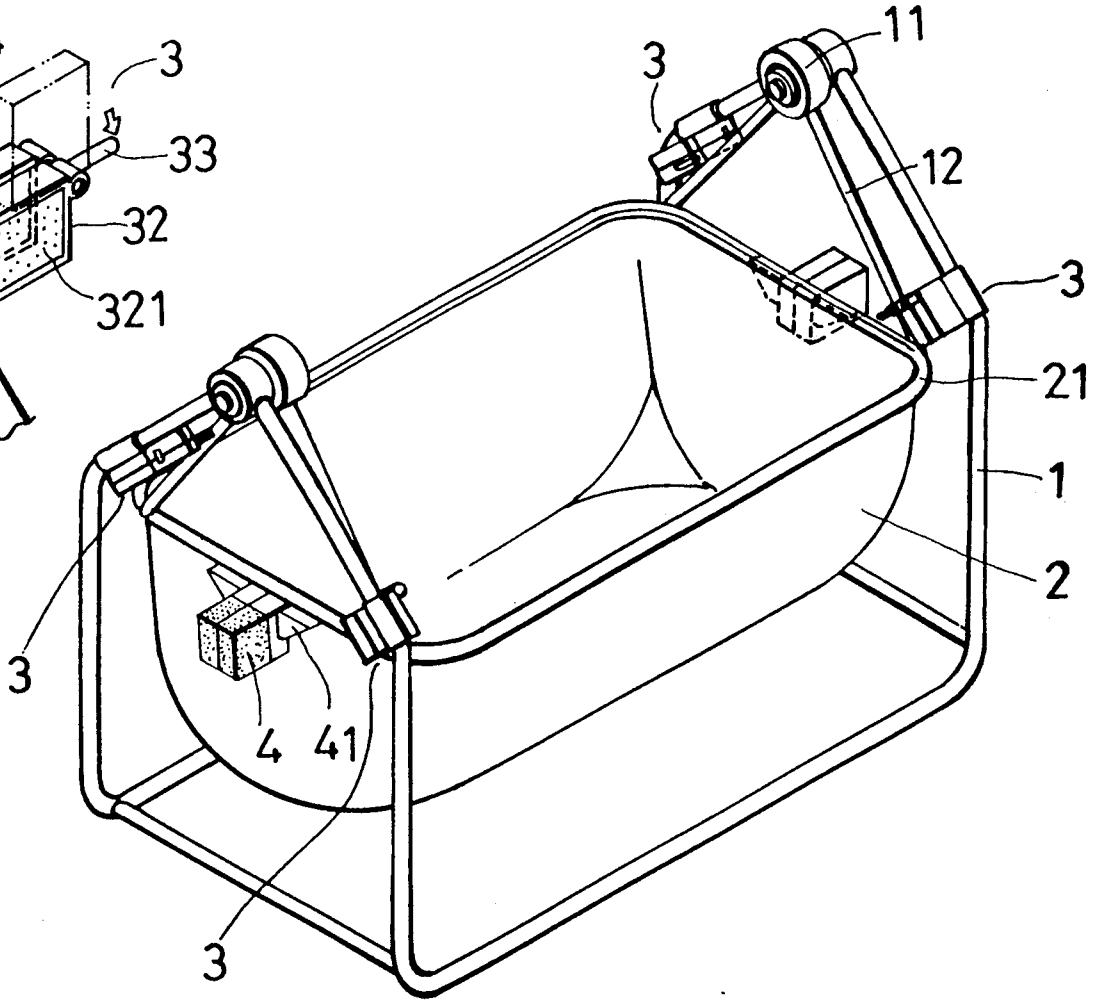
FIG. 1 is a perspective view of the rocking cradle of the present inventive concept.
Figure 2:
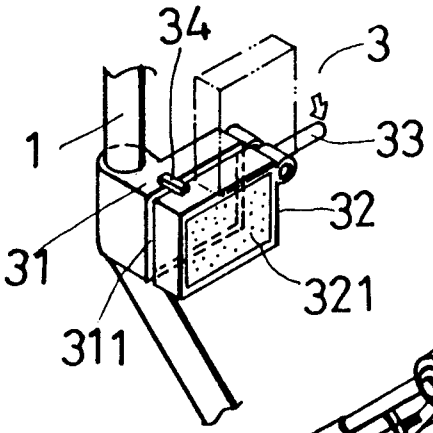
FIG. 2 is a detailed and perspective partially cut away view of a rocking device for the cradle of the present invention.
Figure 4:
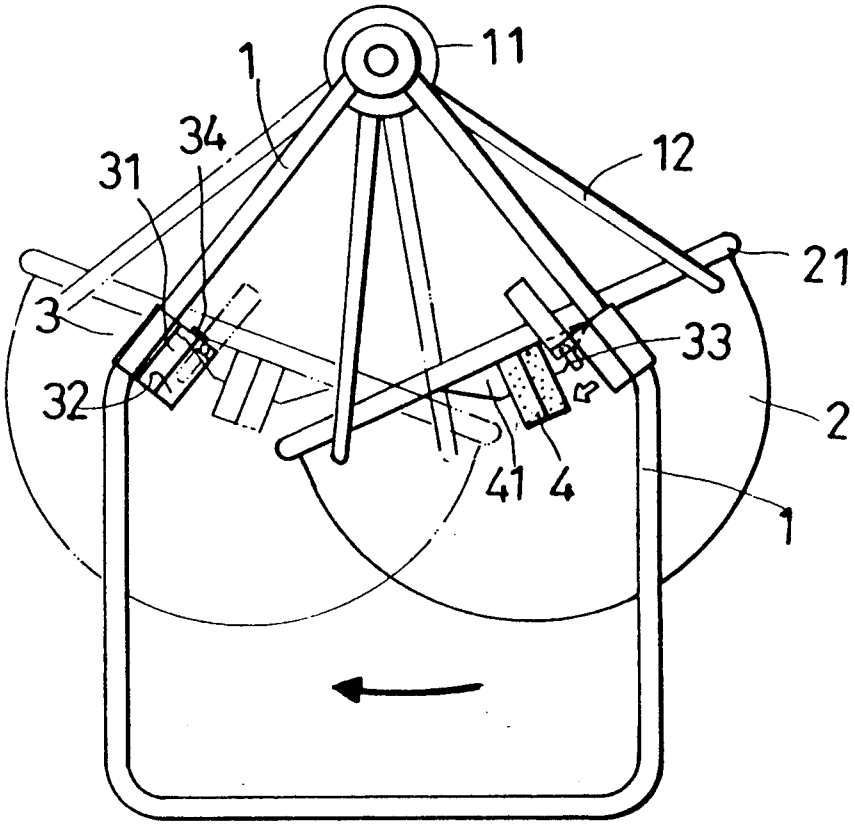

A rocking cradle is shown in FIGS. 1 and 2 which comprises a support frame 1 having a lower section located on a base surface. A hanging cradle 2 is adapted to hang on an upper section of the support frame 1. A rocking device 3 is secured to the support frame 1 and two central magnets 4 are fixed to the cradle 2.

The support frame 1 has two bearing bases 11, 11 at the apex sections of upper inverted V-shaped support frame members located on longitudinally opposite sides of support frame 1. A pair of inverted V-shaped hanging rods 12 are rotatively connected with each bearing base 11 and extend inclinedly in a transverse direction for fixed connection to an upper rectangular frame of the cradle 2.

The rocking device 3 consists of two pairs of actuating units respectively fixed on a bottom section of the inverted V-shaped support frame members of the support frame 1. Each actuating unit includes two magnets 311 and 321. Magnets 311 are encased in an immovable or fixed case 31 which has the same polarity with respect to the central magnets 4, 4 to provide a repelling force therebetween. The magnet 321 is encased in a movable case 32 having an opposite polarity with respect to the movable magnets 4, 4 to provide an attractive force therebetween. The movable case 32 is pivotally connected to the immovable case 31 and a longitudinally extending actuating rod 33 is provided to extend from one side of the movable case 32 as is shown in FIG. 2. A stopper 34 is provided on an upper surface of the movable case 32 and partially lies on an upper surface of the case 31.

The two central magnets 4, 4 are fixed at the center of the longitudinally opposing opposite sides of the upper frame 21 of the cradle 2. A pair of triangular guide blocks 41, 41 are fixed on opposing transverse sides of each magnet 4. The central magnets 4, 4 interact with the magnets 321 and 311 in the rocking device 3 when the cradle 2 cyclically rocks transversely, attracting and repelling each other to generate a rocking force for the cradle to be continuously displaced over an extended period of time before manual intervention is needed.

Figure 3:
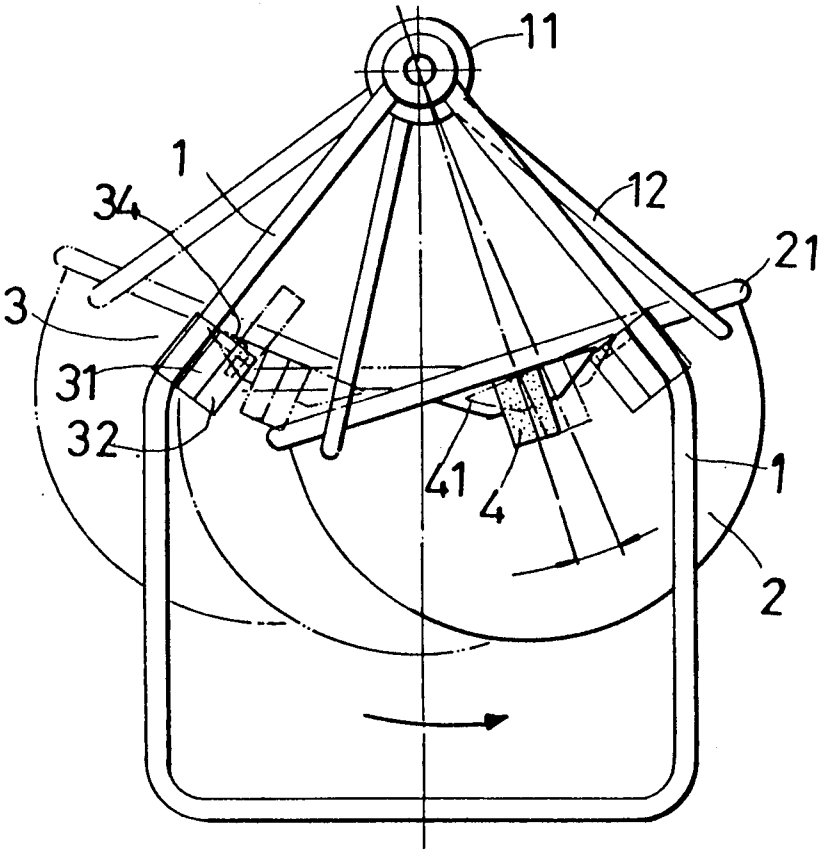
FIG. 3 is a side view of the rocking cradle showing displacement in a first direction; and, FIG. 4 is a side view of the rocking cradle showing displacement in a second direction opposing the first direction.

In using the cradle, the cradle 2 is manually displaced to rock transversely. Then one of the two guide blocks 41 of each magnet 4 contiguously interfaces with actuating rod 33 which is then displaced upwardly. The rod 33 is fixed to the movable case 32 which responsively displaces the case 32 about a pivot as shown in FIG. 3. When the case 32 is not displaced, the magnets 4, 4 will be attracted by the magnets 321 placed in the movable case 32 of different and opposing polarity with respect to the central magnets 4, 4, thus forcing the cradle 2 to move nearer to the case 32 until the triangular guide block 41 compressingly touches and moves the actuating rod 33 so that the movable cases 32, 32 engaging the blocks 41, 41 are further angularly rotated. The central magnets 4, 4 are then released from the attractive forces of the magnets 321 and the magnets 311 are exposed to face against the central magnets 4, 4 causing a repelling force with respect to the central magnets 4, 4 so that the cradle 2 may be moved away. The movable case 32 then rotates back to an aligned position in front of the case 31 and is maintained in position by stopper 34 interfacing with the upper surface of the immovable case 31 to secure the movable case 32 in aligned position in front of the immovable case 31. The cradle 2 then swings to the other side of frame 1, allowing the central magnets 4, 4 fixed with triangular guide blocks 41 to the frame 1 to interact with the movable cases 32, 32 on the other side of frame 1 and then with the immovable cases 31, 31. In this manner, the cradle 2 rocks transversely in a continuous manner until manual intervention is needed to provide more displacement force or to stop the rocking motion.

While the preferred embodiments of the invention have been described above, it will be recognized and understood that various modifications may be made therein and the appended claims are intended to cover all such modifications which may fall within the spirit and scope of the invention.

What is claimed is:

1. A rocking cradle comprising:

(a) a longitudinally extended supporting frame having a lower section and an upper section, said lower section forming an open enclosure, said upper section defining a pair of longitudinally opposing inverted V-shaped support frame members;

(b) a hanging cradle mounted within said open enclosure of said supporting frame, said hanging cradle including a pair of longitudinally opposing inverted V-shaped hanging rod members, each of said inverted V-shaped hanging rod members being fixedly secured to opposing transverse ends of a horizontal frame member of said hanging cradle, each of said inverted V-shaped hanging rod members having an apex section aligned with and pivotally coupled to a respective apex section of a respective one of said inverted V-shaped supporting frame members; and, (c) means for cyclically applying attractive and repulsive forces to said hanging cradle cyclically displacing said hanging cradle in a transverse direction, said means for cyclically applying said forces including at least a pair of central magnets each central magnet having a first polarity exposed transversely toward said frame, said pair of central magnets mounted on at least one longitudinal end of said horizontal frame member and a pair of wedge block members secured to said horizontal frame member and mounted on opposing transverse sides of said central magnets, a first magnet casing fixedly secured to one of said inverted V-shaped support frame members containing a first magnet having said first polarity exposed toward said pair of central magnets, a second magnet casing pivotally coupled to said first magnet casing containing a second magnet having a second polarity opposing said first polarity and exposed toward said pair of central magnets for attracting one of said central magnets, said second magnet casing having an actuating rod member extending longitudinally therefrom and aligned with one of said wedge block members on said hanging cradle for slidingly engaging one of said wedge block members and pivotally displacing said second magnet casing with respect to said first magnet casing, said first and second magnet casings being transversely aligned each to the other by a stop member in contiguous contact with an upper surface of each of said first and second magnet casings whereby one of said central magnets is attracted by said second magnet for displacing said hanging cradle toward said aligned first and second magnet casings followed by said wedge block member contacting said actuating rod to rotate said second magnet casing out of alignment with said first magnet casing thereby exposing said first magnet for applying a repelling force to said central magnet and said hanging cradle.

* * * * *